United States Patent [19]

Kikuchi

[11] Patent Number: 4,958,991

[45] Date of Patent: Sep. 25, 1990

[54] SCROLL TYPE COMPRESSOR WITH DISCHARGE THROUGH DRIVE SHAFT

[75] Inventor: Kazuto Kikuchi, Saitama, Japan

[73] Assignee: Sanden Corporation, Gunma, Japan

[21] Appl. No.: 316,805

[22] Filed: Feb. 28, 1989

[30] Foreign Application Priority Data

Feb. 29, 1988 [JP] Japan ..... 63-44497

[51] Int. Cl.[5] ..... F04C 18/04; F04C 29/02

[52] U.S. Cl. ..... 418/55.6; 418/94; 418/188; 418/DIG. 1

[58] Field of Search ..... 418/55, 88, 94, 188, 418/DIG. 1; 417/902; 184/6.16

[56] References Cited

U.S. PATENT DOCUMENTS

| | | | |
|---|---|---|---|
| 2,420,124 | 5/1947 | Coulson | 417/902 |
| 3,317,123 | 5/1967 | Funke . | |
| 4,365,941 | 12/1982 | Tojo et al. | 417/372 |
| 4,496,293 | 1/1985 | Nakamura et al. | 417/371 |
| 4,547,138 | 10/1985 | Mabe et al. | 418/94 |
| 4,552,518 | 11/1985 | Utter | 418/188 |
| 4,561,832 | 12/1985 | Shimizu | 418/97 |
| 4,666,381 | 5/1987 | Butterworth | 418/88 |

FOREIGN PATENT DOCUMENTS

| | | | |
|---|---|---|---|
| 0317900 | 5/1989 | European Pat. Off. . | |
| 3704874 | 9/1987 | Fed. Rep. of Germany . | |
| 3731837 | 4/1988 | Fed. Rep. of Germany . | |
| 57-18491 | 1/1982 | Japan | 418/188 |
| 59-29791 | 2/1984 | Japan | 418/DIG. 1 |
| 61-87994 | 5/1986 | Japan . | |
| 61-205386 | 9/1986 | Japan . | |
| 63-16190 | 1/1988 | Japan . | |
| WO 85/05403 | 12/1985 | World Int. Prop. O. . | |
| WO 86/00369 | 1/1986 | World Int. Prop. O. . | |

*Primary Examiner*—John J. Vrablik

*Attorney, Agent, or Firm*—Banner, Birch, McKie & Beckett

[57] ABSTRACT

An oil separating mechanism of a hermetically sealed scroll type compressor in which an inner chamber of a housing is kept at discharge pressure is disclosed. The compressor includes a drive shaft supported by a plain bearing in an inner block member. The drive shaft is operatively linked to an orbiting scroll which orbits within a stationary scroll. The drive shaft includes an axial bore extending from an open and termination within the inner block member. A radial bore is provided near the terminal end of the axial bore and links the axial bore to a discharge chamber of the compressor. A helical groove is formed on the exterior surface of the supported portion of the drive shaft. The helical groove is linked to the axial bore through a radial hole formed through the supported portion of the drive shaft. The open end of the axial bore is isolatedly linked to the outlet of the compressor such that refrigerant gas flowing from the discharge chamber to the outlet must flow through the radial bores and axial bore of the drive shaft. Therefore, lubricating oil mixed within the refrigerant gas as a mist is retained at the radial bores and does not flow out of the compressor with the refrigerant gas, increasing the efficiency of the external cooling circuit.

18 Claims, 2 Drawing Sheets

SCROLL TYPE COMPRESSOR WITH DISCHARGE THROUGH DRIVE SHAFT

BACKGROUND OF THE INVENTION

1. Field of the Invention

This invention relates to a scroll type compressor, and more particularly, to an oil separating mechanism for separating lubricating oil from refrigerant gas in a hermetically sealed scroll type compressor.

2. Description of the Prior Art

A hermetically sealed scroll type compressor is disclosed in Japanese Patent Application Publication No. 61-87994 and is shown in FIG. 1. A hermetically sealed housing includes inner chamber 1 which is maintained at discharge pressure The compression mechanism, including inner fitting scrolls 2 and 3 and the forward end of the drive mechanism including drive shaft 130, are disposed between partition 110 and the end plate of stationery scroll 2, and are isolated from inner chamber 1. A plurality of fluid pockets are formed between the spiral portions of inner fitting scrolls 2 and 3. Channel 5 extends through the end plate of orbiting scroll 3 and links intermediate fluid pocket 6 with isolated chamber 7 formed between the end plate of orbiting scroll 3 and partition 110.

In operation, refrigerant gas flows through inlet port 850 and is compressed inwardly by scrolls 2 and 3 towards central fluid pocket 700 due to orbiting motion of orbiting scroll 3. Compressed fluid in central pocket 700 is discharged into discharge chamber 500 through hole 240 extending through the end plate of stationery scroll 2, and thereafter flows to one of the external elements of the refrigerating system through outlet port 860. Additionally, some of the refrigerant gas discharged from hole 240 also flows into inner chamber 1 and is collected therein. After circulating through the refrigeration system, the refrigerant gas which exits through outlet port 860 returns to the compressor.

The discharged refrigerant gas includes lubricating oil mixed therewith as a mist. The lubricating oil mixed with the discharged refrigerant gas will flow to the external elements of the refrigeration system with the discharged refrigerant gas, decreasing the refrigerating efficiency of the refrigeration system. In order to prevent a decrease in the refrigerating efficiency of the system, the lubricating oil must be separated from the discharged refrigerant gas before it flows from outlet port 860.

As disclosed in Japanese Utility Model Application Publication No. 57-69991 and Japanese Patent Application Publication No. 61-205386, an oil separating member may be disposed within the compressor casing to separate the lubricating oil from the refrigerant gas before it is discharged from the compressor. In the '991 application, the outlet port is moved to a location on the right side surface of the compressor so that its longitudinal axis is parallel to the axis of the drive shaft. An oil separating member is disposed within the compressor housing, in an area forward of the outlet port and extending across the inner chamber of the compressor housing. In the '386 application, the oil separating member is disposed on the rear surface of the end plate of the stationery scroll, at a location where it would cover hole 240 in FIG. 1.

In both prior art applications, the lubricating oil intermixed with the compressed refrigerant gas is retained on the surface of the oil separating member as the refrigerant gas moves therethrough, thereby separating the oil from the compressed refrigerant gas. The separated oil forms drops on the oil separating member, and when the drops reach a certain size, they fall from the oil separating member and are collected at the bottom of the compressor housing. In the '386 application, the oil collected at the bottom of the compressor housing flows in to the isolated chamber to lubricate frictional engaging surfaces of the compressor, due to the pressure difference between the discharge chamber and the isolated chamber which is maintained at an intermediate pressure.

However, provision of an oil separating member within the compressor housing complicates the inner structure of the compressor housing, and thereby increases the complications encountered in the process of assembling the compressor. As a result, the manufacturing cost of the compressor is increased.

SUMMARY OF THE INVENTION

It is an object of the present invention to provide a simplified mechanism for separating lubricating oil from compressed refrigerant gas in a hermetically sealed scroll type compressor in which the interior of the compressor housing is maintained at discharge pressure.

A compressor according to the present invention includes a fixed scroll and an orbiting scroll disposed within a hermetically sealed housing. The fixed scroll includes a first end plate from which a first wrap or spiral element extends into the interior of the housing. The orbiting scroll includes a second end plate from which a second spiral element extends. The first and second spiral elements interfit at an angular and radial offset to form a plurality of line contacts which define at least one pair of sealed off fluid pockets therebetween.

An inner block member is fixedly secured within the compressor housing. The first end plate of the fixed scroll is in contact with an annular forward extension of the inner block member to define an isolated suction chamber therebetween in which the first and second spiral elements are disposed. The discharge chamber is formed forward of the first end plate. The remainder of the compressor housing which is exterior to the isolated suction chamber is linked to the discharge chamber. A drive mechanism is operatively connected to the orbiting scroll to effect orbital motion thereof. The drive member includes a drive shaft rotatably supported by a fixed plain bearing within an axially rearward extension of the inner block member. A rotation preventing device prevents rotation of the orbiting scroll during orbital motion so that rotation of the drive shaft creates orbital motion of the orbital scroll. During orbital motion of the orbiting scroll, the volume of the fluid pockets is progressively decreased to compress refrigerant gas in the pockets inwardly from the outermost pockets toward a central pocket. The compressed gas in the central pocket flows through a channel formed in the fixed end plate of the fixed scroll and into the discharge chamber.

The drive shaft includes an axial bore and a plurality of radial bores extending therethrough linking the axial bore to the discharge chamber via an interior chamber maintained at discharge pressure. A helical groove is formed on the exterior surface of the drive shaft and is linked to two radial holes extending through the drive shaft at regular intervals along its length. The radial holes link the helical groove to the axial bore. In operation, the compressed refrigerant gas flows from the discharge chamber to the axial bore through the radial bores extending through the drive shaft, and through the axial bore and out the terminal end of the axial bore adjacent an outlet. The discharged refrigerant gas flows through the outlet to the external elements of the refrigeration circuit. The contact of the refrigerant gas with the surfaces of the radial bores causes a large part of the lubricating oil suspended in the refrigerant gas as a mist to stick to the exterior surface of the drive shaft at the location of the radial bores. Therefore, the level of lubricating oil exiting the compressor with the compressed refrigerant gas is decreased, increasing the cooling efficiency of the external refrigeration circuit. Additionally, lubricating oil may flow through the radial holes, and the external helical groove to lubricate the contact points between the external surface of the drive shaft and the interior surface of the fixed plain bearing.

Further objects, features and other aspect of this invention will be understood from the detailed description of the preferred embodiment of this invention with reference to the annexed drawings.

DETAILED DESCRIPTION OF THE PREFERRED EMBODIMENT

Figure 1:
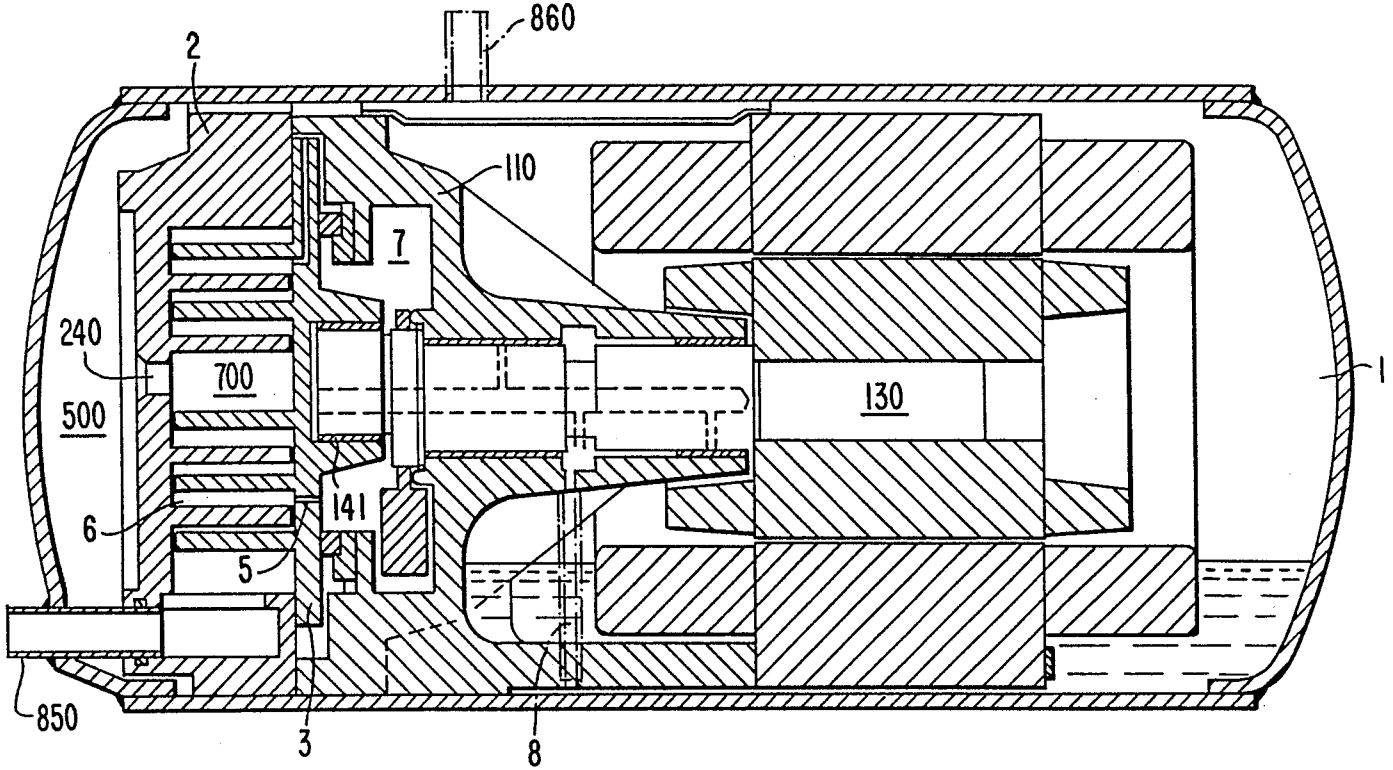
FIG. 1 PRIOR ART
FIG. 1 is a vertical longitudinal section of a hermetically sealed scroll type compressor in accordance with the prior art.
Figure 2:
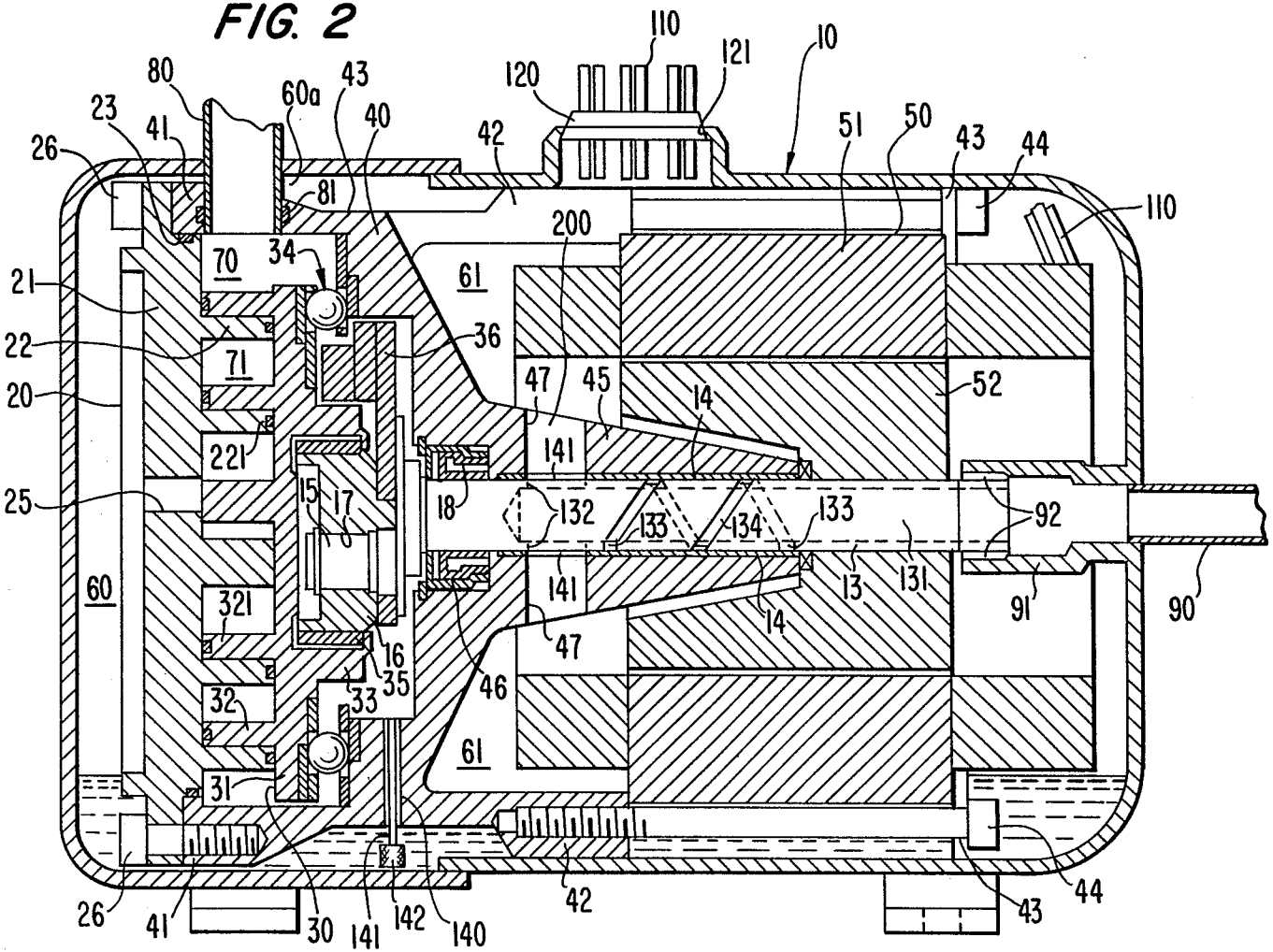
FIG. 2 is a vertical longitudinal section of a hermetically sealed scroll type compressor in accordance with the present invention.

With reference to FIG. 2, a hermetically sealed scroll type compressor in accordance with the present invention is shown. For purposes of explanation only, the left side of the figure will be referenced as the forward end or front and the right side of the figure will be referenced as the rearward end. The compressor includes hermetically sealed casing 10, fixed and orbiting scrolls 20 and 30, respectively, inner block member 40 and motor 50. Fixed scroll 20 includes circular end plate 21 and spiral element or wrap 22 extending rearwardly from the rear end surface of end plate 21. Orbiting scroll 30 includes circular end plate 31 and spiral element or wrap 32 extending forwardly from a front end surface of circular end plate 31. Spiral element 22 of fixed scroll 20 and spiral element 32 of orbiting scroll 30 interfit an angular and radial offset to form a plurality of line contacts which define at least one pair of sealed off fluid pockets 71 therebetween. Annular projection 33 projects axially from the rear surface of circular end plate 31.

Inner block member 40 includes central portion 43 and forward annular wall 41 projecting axially from central portion 43 at a peripheral location. Rearward annular wall 42 projects axially from central portion 43 of block member 40 at a peripheral location and is fixedly disposed on the interior side-surface of casing 10. Axially annular projection 45 projects rearwardly from central region 43 at a central location. The forward end surface of forward annular wall 41 is fixed by a plurality of screws 26 to the rearward peripheral surface of circular end plate 21 of fixed scroll 20. Isolated suction chamber 70 is thereby created between annular wall 41 of inner block member 40, and fixed scroll 20. Orbiting scroll 30 is disposed entirely within isolated suction chamber 70.

Motor 50 includes stator 51. Ring member 43 is disposed on the peripheral end surface of stator 51 and includes an outer surface which extends beyond the side surfaces of stator 51. Bolts 44 fit through a plurality of holes formed through the peripheral outer surface of ring member 43 and are fixedly secured within corresponding threaded receiving holes of rearward annular wall 42. Stator 51 contacts the rear end surface of rearward annular wall 42 on its forward surface. Therefore, stator 51 of motor 50 is secured between ring member 43 and rearward annular wall 42 of inner block member 40. Rotor 52 of motor 50 is disposed within stator 51 and is fixed to drive shaft 13 extending therethrough. Drive shaft 13 extends through axial annular projection 45. Axial annular projection 45 extends within an opening in rotor 52. Drive shaft 13 is rotatably supported within axial annular projection 45 through fixed plain bearing 14 disposed between the exterior surface of drive shaft 13 and the interior surface of axial annular projection 45. Drive shaft 13 extends through central portion 43 of inner block member 40 and fixed plain bearing 14 extends partly within central region 43 to support drive shaft 13 at that location.

Drive shaft 13 includes axial bore 131 extending from an opening at the rearward end surface of drive shaft 13 and terminating within drive shaft 13 at a region within central portion 43 of inner block member 40. A plurality of radial bores 132 extend through drive shaft 13, at a location within annular projection 45, near the terminal end of axial bore 131. A plurality of communication holes 47 are formed through axial annular projection 45 and correspond to the plurality of radial bores 132. Radial bores 132 and communication holes 47 are linked by a corresponding plurality of holes 141 formed through fixed plain bearing 14. Holes 47, bores 132, and holes 141 form communication channel 200.

Axial bore 131 is linked by communication channel 200 to interior chamber 61 formed in the hollow portion of inner block 40 between wall 42 and projection 45. Interior chamber 61 is linked to discharge chamber 60 via cavity 60a located between the interior side surface of casing 10 and the exterior surface of forward annular wall 41. Therefore, interior chamber 61 is maintained at discharge chamber pressure. Helical groove 134 is formed on the exterior surface of drive shaft 13 within axial annular projection 45. A pair of radial holes 133 extends through drive shaft 13, one at the forward terminal end of helical groove 134 located near bores 132, and the other at the rearward terminal end of helical groove 134 disposed near the terminal end of axial annular projection 45. Radial holes 133 link helical groove 134 to axial bore 131.

Axial annular projection 91 extends forwardly from the inner surface at the rear end of casing 10 at a central location. Discharge gas outlet pipe 90 extends through an opening in the rear end of casing 10, into the interior region of annular projection 91. Additionally, the rearward terminal end of drive shaft 13 extends into annular projection 91 and is rotatably supported therein by bearing 92. The terminal end of drive shaft 13 and the interior terminal end of discharge gas outlet pipe 90 are disposed adjacent to each other within annular projection 91, and therefore, the opening of axial bore 131 is isolatedly linked to outlet pipe 90 via the interior space of annular projection 91.

Pin member 15 is integral with and projects axially from the forward end surface of drive shaft 13. Pin member 15 is radially offset from the axis of drive shaft 13. Bushing 16 is rotatably disposed within rearward axial annular projection 33 of orbiting scroll 30 and is supported therein by bearing 35. Pin member 15 is inserted in hole 17 of bushing 16 which is offset from the center of bushing 16.

Rotation preventing device 34 is disposed between a rearward peripheral surface of circular end plate 31, exterior of annular projection 33, and a forward surface of inner block member 40 to prevent rotation of orbiting scroll 30 during orbital motion. O-ring seal 23 is disposed between an inner peripheral surface of forward annular wall 41 and a part of the exterior peripheral surface of circular end plate 21 to seal the mating surfaces therebetween.

Hole 25 is formed through a central location of circular end plate 21 and links discharge chamber 60 at the rear of circular end plate 21 with the central fluid pocket 71 formed between the spiral elements. Seal elements 221 and 321 are disposed between the end surfaces of spiral element 22 and the surface of circular end plate 31, and the end surface of spiral element 32 and the end surface of circular end plate 21, respectively. Spiral elements 22 and 32, as well as rotation preventing device 34, pin member 15 and bushing 16 are all contained in suction chamber 70.

Cavity 46 is formed in central portion 43 of inner block member 40, at a location forward of axial annular projection 45. Drive shaft 13 extends into cavity 46. Shaft seal mechanism 18 is disposed within cavity 46, around drive shaft 13 to prevent refrigerant gas from leaking from discharge chamber 60 into suction chamber 70 due to the rotation of drive shaft 13. Balance weight 36 is disposed on a rearward extension of bushing 16 and serves to average the torque of drive shaft 13 acting on bushing 16 during rotation. Suction gas inlet plate 80 radially penetrates casing 10 and forward annular wall 41, and opens into suction chamber 70. O-ring seal 81 is disposed around the outer peripheral surface of inlet pipe 80 and seals the mating surfaces between inlet pipe 80 and forward annular wall 41.

Opening 121 is formed in a top surface of casing 10. Hermetic seal base 120 is secured to casing 10 within opening 121 and maintains the hermetic seal of casing 10. Wires 110 extend from the rear end of stator 51, and pass through hermetic seal base 120 for connection to an external electrical power source (not shown). Base 120 may be welded or brazed to casing 10 to provide the hermetic seal therebetween.

Conduit 140 is radially formed through inner block member 40 at a lower portion thereof. Conduit 140 links the interior of casing 10 maintained at discharge chamber pressure to suction chamber 70, and lubricating oil which accumulates at the inner bottom portion of casing 10 flows through orifice 141 fixedly disposed within conduit 140 by virtue of the pressure difference between discharge chamber 60 and suction chamber 70. Filter element 142 is attached at the lower end of orifice 142 and is immersed in the accumulated pool of lubricating oil.

In operation, stator 51 generates a magnetic field, causing rotation of rotor 52 to thereby rotate drive shaft 13. Rotation of drive shaft 13 is converted to orbital motion of orbiting scroll 30 by pin member 15 and bushing 16, and rotational motion of orbiting scroll 30 is prevented by rotation preventing device 34. Refrigerant gas is introduced into suction chamber 70 from the external refrigeration circuit through suction gas inlet pipe 80 and is taken into the outer of fluid pockets 71 between fixed scroll 20 and orbiting scroll 30. Refrigerant gas is compressed inwardly toward the central pocket of spiral elements 22 and 32 due to the orbital motion of orbiting scroll 30. As the refrigerant fluid moves towards the central pocket, it undergoes a resultant volume reduction and compression and is discharged from the central pocket to discharge chamber 60 through hole 25 covered by a one way valve (not shown).

Compressed refrigerant gas flows from discharge chamber 60 into interior chamber 61 through cavity **60*a*. Compressed discharge gas in interior chamber 61 flows out of the compressor to the external fluid circuit via communication holes 47 formed in axial annular projection 45, holes 141 formed in fixed plain bearing 14, radial bores 132 formed through drive shaft 13, axial bore 131, annular projection 91 and discharge gas outlet pipe 90**.

The oil separating mechanism of the present invention operates as follows. Compressed refrigerant gas including lubricating oil mixed therewith as a mist is discharged into discharge chamber 60 and flows into interior chamber 61. As the refrigerant gas flows into axial bore 131 of drive shaft 13, it must first move through communication holes 47 and radial bores 132. A large part of the lubricating oil is separated from the refrigerant gas and is maintained on the exterior surface of drive shaft 13 at the location of radial bores 132 due to the contact of the refrigerant gas containing the lubrication oil with the surface of drive shaft 13 at bores 132. Part of the retained lubricating oil flows into the gap between fixed plain bearing 14 and the exterior surface of drive shaft 13 at a location forward of bores 132 to lubricate the contact surfaces. Additionally, part of the lubricating oil flows into helical groove 134 through the forward radial hole 133 and thereafter flows through helical groove 134 to effectively lubricate the contact surface between fixed plain bearing 14 and the exterior surface of drive shaft 13 rearward of bores 132. After flowing through helical groove 134, the lubricating oil flows through rearward radial hole 133 and into bore 131.

The remainder of the retained lubricating oil which does not flow into either the forward gap between fixed plain bearing 14 and drive shaft 13, or into helical groove 134, forms droplets on the surface of drive shaft 13 at the region of radial bores 132. When the droplets are large enough, they fall off of drive shaft 13 and are collected at the bottom of casing 10. The oil collected in the bottom of casing 10 is supplied to suction chamber 70 through orifice 141 due to the pressure difference between discharge chamber 60 and suction chamber 70. Lubricating oil flowing to suction chamber 70 lubricates the frictional contact surfaces of bushing 16, pin 15, rotation preventing device 34, and spiral elements 22 and 32.

This invention has been described in detail in connection with the preferred embodiment. This embodiment, however, is merely for example only and the invention is not restricted thereto. It will be understood by those skilled in the art that other variations and modifications can be easily made within the scope of this invention as defined by the appended claims.

I claim:

1. In a scroll type compressor with a hermetically sealed housing, said compressor comprising a fixed scroll disposed within said housing, said fixed scroll having a first end plate from which a first spiral element extends, an orbiting scroll having a second end plate from which a second spiral element extends, said first and second spiral elements interfitting at an angular and radial offset to form a plurality of line contacts which define at least one pair of sealed off fluid pockets, a drive mechanism operatively connected to said orbiting scroll to effect orbital motion of said orbiting scroll, a rotation preventing means for preventing the rotation of said orbiting scroll during orbital motion whereby the volume of said fluid pockets changes to compress fluid in said pockets, said drive mechanism including a drive shaft rotatably supported within an inner block member, said inner block member fixedly secured to said housing, said first end plate of said fixed scroll and said inner block member forming a suction chamber therebetween, a discharge chamber formed exterior to the suction chamber between the outer surfaces of said first end plate and said inner block member and the interior surfaces of said housing, said first and second spiral elements disposed in said suction chamber, the improvement comprising:

said drive shaft having an axial bore and at least one radial bore extending through the surface of said drive shaft and linking said axial bore to said discharge chamber, said housing having an outlet, said axial bore having an opening isolated from said discharge chamber, said opening coupled to said outlet.

2. The sealed scroll type compressor of claim 1, said drive shaft having at least one radial hole extending through its exterior surface and linked to said axial bore, and a helical groove formed on an exterior surface of said drive shaft and linked to said axial bore by said radial hole.

3. The sealed scroll type compressor of claim 1, said inner block member comprising an axial annular projection extending therefrom, said drive shaft supported by a fixed plain bearing disposed between an interior surface of said axial annular projection and an exterior surface of said drive shaft.

4. The sealed scroll type compressor of claim 3 further comprising at least one communication channel linking said discharge chamber to said axial bore, said communication channel comprising at least one hole formed through said inner block member, at least one hole formed through said bearing, and said at least one radial bore.

5. The sealed scroll type compressor of claim 3, said axial bore of said drive shaft extending from an opening at one end of said drive shaft to a closed end near an opposite end of said drive shaft.

6. The sealed scroll type compressor of claim 5, said radial bore linking said axial bore to said discharge chamber near its closed end.

7. The sealed scroll type compressor of claim 1 further comprising an axially annular projection extending from an inner surface of said housing, said drive shaft extending into said annular projection such that said opening of said axial bore is disposed within said annular projection and said opening is isolated from said discharge chamber.

8. The sealed scroll type compressor of claim 7, said housing provided with a refrigerant gas outlet port extending therethrough into said annular projection and opening adjacent said opening of said axial bore.

9. The sealed scroll type compressor of claim 1 further comprising a cavity formed at a central portion of said inner block member within said suction chamber, and a shaft seal mechanism disposed within said cavity to prevent leakage of refrigerant gas from said discharge chamber to said suction chamber due to the rotation of said drive shaft.

10. The sealed scroll type compressor of claim 1 further comprising a suction gas inlet pipe radially penetrating said housing and said inner block member, and opening into said suction chamber.

11. The sealed scroll type compressor of claim 1 further comprising a conduit radially formed through said inner block member linking said discharge chamber with said suction chamber, lubricating oil collected in said housing flowing through said conduit into said suction chamber from said discharge chamber due to the pressure difference between said discharge and said suction chambers.

12. In a scroll type compressor with a hermetically sealed housing, said compressor comprising a fixed scroll disposed within said housing, said fixed scroll having a first end plate from which a first spiral element extends, an orbiting scroll having a second end plate from which a second spiral element extends, said first and second spiral elements interfitting at an angular and radial offset to form a plurality of line contacts which define at least one pair of sealed off fluid pockets, a drive mechanism operatively connected to said orbiting scroll to effect orbital motion of said orbiting scroll, a rotation preventing means for preventing the rotation of said orbiting scroll during orbiting motion whereby the volume of said fluid pockets changes to compress fluid in said pockets, said drive mechanism including a drive shaft rotatably supported within an inner block member, said inner block member fixedly secured to said housing, said first end plate of said fixed scroll and said inner block member forming a suction chamber therebetween, a discharge chamber formed exterior to the suction chamber between the outer surfaces of said first end plate and said inner block member and the interior surfaces of said housing, said first and second spiral elements disposed in said suction chamber, the improvement comprising said drive shaft having an axial bore, at least one radial bore extending through the surface of said drive shaft and linking said axial bore to said discharge chamber, a helical groove formed on and about the exterior surface of said drive shaft, and at least one radial hold extending through the surface of said drive shaft and linking said axial bore with said helical groove wherein, the fluid is mixed with lubricating oil, compressed fluid from said discharge chamber flows into said axial bore through said radial bore, and a portion of the lubricating oil mixed with the fluid flows through said radial bore and into said axial bore, the lubricating oil portion further flowing through said radial hole and into said helical groove to lubricate the contact surface between said drive shaft and said inner block member.

13. The compressor recited in claim 12 further comprising a bearing disposed between an interior surface of said inner block member and an exterior surface of said drive shaft.

14. The compressor recited in claim 12, said inner block member comprising an axial annular projection extending therefrom, said drive shaft supported by a fixed plain bearing disposed between an interior surface of said axial annular projection and an exterior surface of said drive shaft, said helical groove extending along the length of said drive shaft within said axial annular projection.

15. The compressor recited in claim 14 further comprising at least one communication channel linking said discharge chamber to said axial bore, said communication channel comprising at least one hold formed through said inner block member, at least one hold formed through said bearing, and said at least one radial bore, said communication channel disposed at a location beyojnd one end of said helical groove.

16. The compressor recited in claim 12 further comprising a conduit radially formed through said inner block member linking said discharge chamber with said suction chamber, lubricating oil collected in said housing flowing through said conduit into said suction chamber from said discharge chamber due to the pressure difference between said discharge and said suction chambers.

17. The compressor recited in claim 12, said at least one radial hold comprising two radial holes disposed at each terminal end of said helical groove.

18. The compressor recited in claim 12 further comprising an axially annular projection extending from an inner surface of said housing, said axial bore having an opening, said drive shaft extending into said annular projection such that said opening of said axial bore is disposed within said annular projection and said opening is isolated from said discharge chamber.

* * * * *